US007000864B2

(12) United States Patent
McNeil et al.

(10) Patent No.: US 7,000,864 B2
(45) Date of Patent: Feb. 21, 2006

(54) CONSUMER PRODUCT WINDING CONTROL AND ADJUSTMENT

(75) Inventors: Kevin B. McNeil, Loveland, OH (US); Michael Joseph Guyant, Alexandria, KY (US); Thomas Timothy Byrne, West Chester, OH (US); James Fred Johnson, Oxnard, CA (US)

(73) Assignee: The Procter & Gamble Company, Cincinnati, OH (US)

( * ) Notice: Subject to any disclaimer, the term of this patent is extended or adjusted under 35 U.S.C. 154(b) by 430 days.

(21) Appl. No.: 10/166,283

(22) Filed: Jun. 10, 2002

(65) Prior Publication Data

US 2003/0226928 A1 Dec. 11, 2003

(51) Int. Cl.
*B65H 23/18* (2006.01)

(52) U.S. Cl. ..... 242/413.9

(58) Field of Classification Search ..... 242/419.2, 242/413.1, 413.2, 413.3, 413.9
See application file for complete search history.

(56) References Cited

U.S. PATENT DOCUMENTS 3,871,598 A * 3/1975 Kataoka ..... 242/413.2
3,934,837 A 1/1976 Keilhack et al.
4,238,084 A * 12/1980 Kataoka ..... 242/413.1
4,358,067 A * 11/1982 Kanda et al. ..... 242/413.2
4,438,889 A * 3/1984 Schonmeier ..... 242/413.1
4,508,284 A 4/1985 Kataoka
4,588,138 A 5/1986 Spencer
4,720,661 A * 1/1988 Kisakibaru et al. ..... 424/413.2
4,723,724 A 2/1988 Bradley
4,744,526 A 5/1988 Kremar
4,828,195 A 5/1989 Hertel et al.
4,856,725 A 8/1989 Bradley
4,883,233 A 11/1989 Saukkonen et al.
4,909,452 A 3/1990 Hertel et al.
4,962,897 A 10/1990 Bradley
4,974,784 A 12/1990 Steidle
4,993,650 A 2/1991 Nickell
5,104,055 A 4/1992 Buxton
5,320,299 A 6/1994 Fitzpatrick et al.
5,370,335 A 12/1994 Vigneau
5,421,536 A 6/1995 Hertel et al.
5,437,417 A * 8/1995 Kammann ..... 242/413.1
5,497,959 A 3/1996 Johnson et al.
5,505,402 A 4/1996 Vigneau
5,542,622 A 8/1996 Biagiotti
5,611,500 A 3/1997 Smith
5,662,758 A 9/1997 Hamilton et al.
5,725,176 A 3/1998 Vigneau
5,755,522 A 5/1998 Ito
5,800,247 A 9/1998 Harms
5,871,607 A 2/1999 Hamilton et al.
5,913,490 A 6/1999 McNeil et al.
5,941,473 A * 8/1999 Kawano et al. ..... 242/413.1
5,965,235 A 10/1999 McGuire et al.
5,968,633 A 10/1999 Hamilton et al.

(Continued)

*Primary Examiner*—William A. Rivera
(74) *Attorney, Agent, or Firm*—Peter D. Meyer; David K. Mattheis

(57) ABSTRACT

Apparatus and method for controlling the winding of a sheet of material such as paper and film finished consumer products into a log using an adjustable reference profile. The apparatus and method may provide improved process control, product quality, manufacturing production rate and/or process repeatability. The apparatus and method provide more consistent finished log properties by measuring at least one process parameter during the manufacturing process. The process parameter is then correlated with the desired finished product characteristics and an appropriate correction is made to the reference profile.

19 Claims, 6 Drawing Sheets

U.S. PATENT DOCUMENTS

| | | | | |
|---|---|---|---|---|
| 6,056,229 | A | 5/2000 | Blume et al. | |
| 6,062,507 | A | 5/2000 | Summey, III | |
| 6,089,496 | A | 7/2000 | Dorfel | |
| 6,091,500 | A | 7/2000 | Bahr et al. | |
| 6,099,940 | A | 8/2000 | Hamilton et al. | |
| 6,158,687 | A | 12/2000 | Widmer | |
| 6,189,824 | B1 | 2/2001 | Stricker | |
| 6,189,825 | B1 | 2/2001 | Mathieu et al. | |
| 6,193,918 | B1 | 2/2001 | McGuire et al. | |
| 6,194,062 | B1 | 2/2001 | Hamilton et al. | |
| 6,223,050 | B1 | 4/2001 | Roberts, Jr. | |
| 6,254,965 | B1 | 7/2001 | McGuire et al. | |
| 6,283,402 | B1 | 9/2001 | Fordham | |
| 6,289,600 | B1 | 9/2001 | Watts | |
| 6,375,112 | B1 * | 4/2002 | Engelhardt | 242/419.2 |
| 6,402,076 | B1 * | 6/2002 | Werner | 242/413.1 |

* cited by examiner

CONSUMER PRODUCT WINDING CONTROL AND ADJUSTMENT

FIELD OF THE INVENTION

A method and apparatus for winding sheets of material such as paper, film, textile, plastic, food, three-dimensionally shaped formed film and adhesive combinations, or other materials. The apparatus and method control the winding speed, winding tension and/or the winding density of the wound sheet of material.

BACKGROUND OF THE INVENTION

An important factor for determining the quality of a wound sheet of material is the winding speed. Generally, winding speed can be used to control the winding tension and/or the winding density. The winding speed is especially important for sheet materials including film and adhesive combinations where the majority of the adhesive lies in the recesses of the film. Although various mechanisms and apparatuses have been proposed for winding and unwinding operations, problems have been presented in maintaining a uniform wound product.

In various manufacturing operations for producing textiles, felts, papers, films, etc., it is necessary to wind a sheet of material into a roll. Where the sheet of material is a uniform and repeatable rolled consumer product, the roll may be referred to as a log. Consumer product logs are often much smaller than the commercial rolls used in other applications. Further, sheets of material such as paper products or film-adhesive combinations may have little or no tension applied at certain points in the rolling process. The winding quality and material properties such as thickness and appearance are strongly influenced by the tension that is present in the sheet of material during the winding operation. This is particularly true for the winding of adhesively coated sheets of material such as film-adhesive combinations. During winding, the process tension may result in some of the wound layers bonding together at various locations in the wind. It has been found that a better, faster and more repeatable control mechanism is possible through controlling the material log speed with a reference profile that is adjustable based upon measured process parameters.

Despite the efforts to improve the winding of material, there remains a need for improvements in the speed, control, and effectiveness of devices for producing wound consumer logs of material.

Several patents describe alternative winding approaches for various purposes. Such efforts are described in U.S. Pat. No. 4,588,138, issued to Spencer, U.S. Pat. No. 4,508,284 issued to Kataoka, U.S. Pat. No. 4,744,526 issued to Kremar, U.S. Pat. No. 5,611,500 issued to Smith, U.S. Pat. No. 3,934,837 issued to Keilhack, et al., U.S. Pat. No. 6,189,824 issued to Stricker, U.S. Pat. No. 4,883,233 issued to Saukkonen, et al. and U.S. Pat. No. 6,189,825 issued to Mathieu, et al.

An object of the present invention is to provide a winding apparatus for paper, textile, plastic, or other sheets of material, which has advantageous winding characteristics for consumer size logs using at least one reference profile. Another object of the invention is to manufacture logs with a smaller diameter variation. It is also an object of the present invention to provide a log with a more consistent wind tension such that the force required to unwind the sheet of material from the log is relatively constant throughout the log. This is especially important for film-adhesive combinations where the bonding of the sheets to one another inside the log can be a problem. Further objects, features, and advantages of the invention will become apparent from the detailed description that follows.

SUMMARY OF THE INVENTION

The invention provides a method and apparatus for winding a sheet of material such as paper and film finished products using a reference profile, thereby improving product quality, manufacturing rate and reliability. Many commercial consumer product winding systems may be used including center winding systems, surface winding systems, and translating systems. The proposed method and apparatus are designed to provide improved consumer product quality in high-speed converting operations making small, consumer size logs.

In one embodiment, the method includes using a winding apparatus to wind a sheet of material onto a core to form a log. The core has a variable rotational velocity during the winding operation. The material is wound into the log in accordance with a reference profile. A process parameter is measured to obtain at least one process parameter measurement. The reference profile is adjusted according to the at least one process parameter measurement. In one embodiment the reference profile controls and/or defines the core rotational velocity changes during the winding process. Preferably, the winding rotational velocity changes a minimum of about 400 revolutions per minute between about 2 and about 35 machine degrees. More preferably, the velocity change is a decrease of about 400 revolutions per minute between about 2 and about 35 machine degrees.

In one embodiment, the winding apparatus includes a mandrel, a drive system, a material handling system, an adjustable reference profile, and a process parameter measuring device. A core is removably disposed about the mandrel. The drive system drives the mandrel, and winds the sheet of material onto the core to form a log. The material handling system delivers the sheet of material to the mandrel and/or core. In one embodiment, the reference profile is the winding speed in rotations per minute (RPM) vs. machine degrees. The process parameter measuring device measures at least one process parameter. A process parameter may be measured more than once on any given log. The logs may be measured at any interval of logs.

In one embodiment, the process parameter measured is log diameter. The log diameter measurement is compared to a reference and a correction to the reference profile is made which affects the winding log and/or subsequent logs. The minimum core rotational velocity change during winding is about 400 revolutions per minute between about 2 and about 35 machine degrees. Alternatively, the minimum core rotational velocity change is 4% in the first 10 revolutions after start of winding, or 8% in the first 20 revolutions, or 12% in the first 30 revolutions.

All documents cited are, in relevant part, incorporated herein by reference; the citation of any document is not to be construed as an admission that it is prior art with respect to the present invention.

BRIEF DESCRIPTION OF THE DRAWINGS

The various advantages of the present invention will become apparent to skilled artisans after studying the following specification and by reference to the drawings in which.

Like elements may have like numbers in more than one drawing in order to reduce the number of different numerical identifiers used for a particular element.

DETAILED DESCRIPTION OF THE INVENTION

Figure 1:
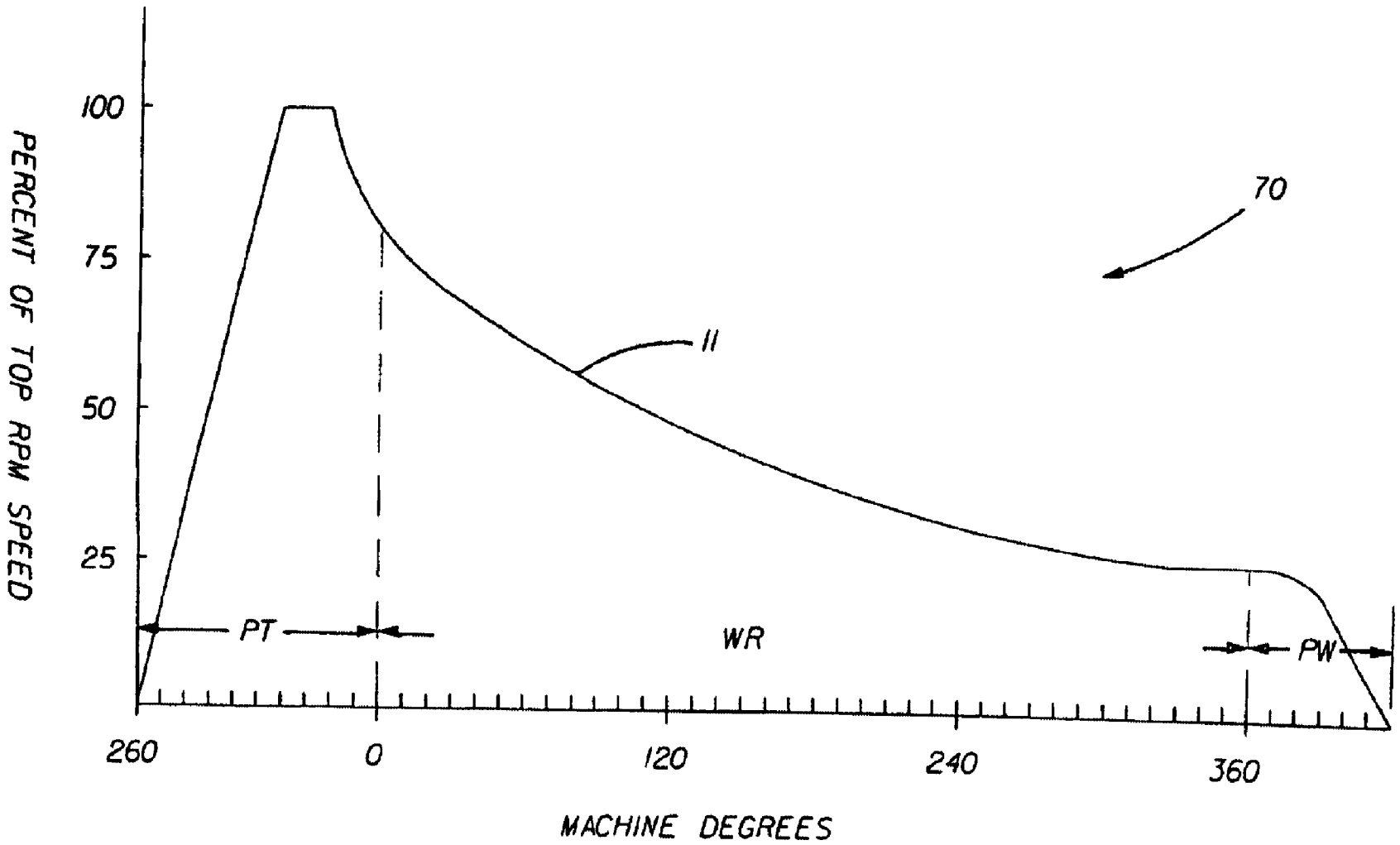
FIG. 1 is a generic graphical view of a speed reference profile.

The present invention controls the wind characteristics of consumer logs using at least one measured process parameter to adjust a reference profile. The reference profile reflects a desired target process parameter value at a particular point in the process. This reference profile value is compared with a measured process parameter value. The reference profile is used to control at least one aspect of a wind apparatus or wind method. Further process parameter measurements lead to further adjustments in the reference profile as necessary to deliver the desired consumer size wind of a sheet of material, called a log. The reference profile adjustments reduce the process parameter variation during and/or between log windings. The adjustments can also be used to control the internal tension and compressive forces between the layers of sheet of material in the log. Internal log tension control is particularly desirable for film-adhesive combinations.

Definitions

The terms used herein have the following meanings:

"Disposed" is used to mean that an element(s) is formed or positioned in a particular place or position as a unitary structure. The element may be joined or not joined to other elements.

"Joined" encompasses configurations whereby an element is directly secured to another element by affixing the element directly to the other element, and configurations whereby an element is indirectly secured to another element by affixing the element to intermediate member(s), which in turn are affixed to the other element.

"Comprise," "comprising," and "comprises" are open ended terms that specify the presence of what follows e.g. a component, but does not preclude the presence of other features, elements, steps or components known in the art, or disclosed herein.

"Compression" refers to a load that tends to squeeze or press an article together.

"Tension" refers to force tending to stretch or elongate an article.

"Sheet of material" refers to any flexible material that can be rolled into a log. Examples include film, aluminum foil, paper, cloth, food, wovens, scrims, meshes, nonwovens, combinations thereof and the like.

"Log" refers to an in process, near complete or completed wind of at least a portion of a sheet of material into a consumer size wind of material. A log may be the same product width sold retail to the public or it may be a multiple of the retail width. If it is a multiple of the retail width it can be subsequently cut into retail widths.

"Consumer size" refers to a finished product diameter generally sold retail to the public.

"Wind" refers to the rotational process of rolling a sheet of material into a log.

"Core" refers to a component that remains with the log after winding and provides internal support.

"Caliper factor" refers to the theoretical spacing between sheet of material winding layers on a log. The Caliper Factor and/or log diameter measurements may be used to influence the instantaneous slope of the line 11 in FIG. 1. The slope may change from a fixed pivot point on the line.

"Max line speed" refers to a scalar that moves the line 11 in FIG. 1 vertically without changing the slope of the line.

"Robustness" refers to being insensitive to small changes, variations, or inaccuracies.

"Machine degree" refers to specified equivalent portions of a repeating winding cycle. Any number of machine degrees may be used to represent equivalent intervals in the wind cycle. As used herein the basis for calculating machine degrees is that there are 360 equivalent machine degrees in each wind region of the winding cycle. For example, a log with 720 revolutions per log in the wind region would have the revolutions divided by 360 for two revolutions per machine degree.

The Reference Profile

For any given log product, there is at least one reference profile 70 for the winding process. FIG. 1 shows a generic reference profile 70. The reference profile 70 is designed to yield a log with desired properties. These log properties include a preferred wind tension, log diameter, and log material density. In one embodiment, the reference profile 70 provides a relatively consistent in-wound tension and/or compression throughout the log. This is provided in part by properly locating or spacing each layer of paper or film throughout the log.

The reference profile 70 may control the winding apparatus and/or one or more components of the winding apparatus. For example, the reference profile 70 may control the sheet of material tension during winding, the wind speed, the length of material being wound, the core angular displacement, the drive system, the relationship between one or more of these parameters, or other winding measurement parameters.

As shown in FIG. 1, the reference profile 70 may be a speed reference profile 70 of the log speed in revolutions per minute (RPM) at a specified machine degree (RPM vs. machine degree). The wind RPM is shown in FIG. 1 as a percentage of the top motor speed in the winding process. Target speeds are established at multiple machine degrees in the winding cycle. To maximize accuracy there are preferably several speed reference points spaced in equal increments within each machine degree. For example, there may be 2048 speed reference points in each winding cycle, or approximately 5.689 points per machine degree. The combination of speed v. machine degree provides the speed reference profile 70. The reference profile 70 in FIG. 1 may have any shape needed to properly wind the sheet of material into a log.

As shown in FIG. 1, a pre-transfer region PT between about 260 degrees and about 0 degrees represents the acceleration and deceleration period prior to winding the log. At about 0 degrees, the mandrel/core and the sheet of material speeds are matched or nearly matched as the two are connected. The post winding PW region between about 360 degrees and about 60 degrees represents the deceleration period after the log is complete and the sheet of material feed has been separated from the log. The wind region WR is between about 0 degrees and about 360 degrees. This represents the period when the sheet of material is wound onto the core to form a log.

The reference profile 70 is designed to be adjustable and/or changed by reference profile adjustments. Reference profile adjustments may be made by changing the max line speed and or the caliper factor. The reference profile adjustments are made as needed and indicated by comparing actual process parameter measurements with theoretical or target process parameters.

A control device may be used to adjust the reference profile 70 based upon variations in the measured process parameter. Preferably, the reference profile adjustments are calculated by computer and automatically updated. The difference between the measured and target process parameter data provides the primary input for calculating the reference profile.

Data from the log being wound may be used to make reference profile adjustments. More preferably, the data from more than one log may be used to make reference profile adjustments. Generally, the measured process parameter vs. a target process parameter comparisons are made at selected points in the wind process. For example, a process parameter measurement could be the log diameter measured at one or more selected machine degrees. The process parameter measurement may be taken at a machine degree anywhere from about 0 to about 360 machine degrees. Preferably, the process parameter measurement may be taken at least once at anywhere from about 10 machine degrees to about 358 machine degrees. More preferably, the process parameter measurement may be taken at least once at anywhere from about 340 machine degrees to about 360 machine degrees. In one embodiment, one measurement on a log may be taken at about 356 degrees. If the log diameter is larger than desired, the winding speed and thus the winding tension may be increased to compress and reduce the log diameter during winding. Subsequent log diameters at the specified degree location may be measured to assess the effect of the reference profile 70 speed/tension change.

The reference profile adjustments and process parameter measurements may be made at any frequency and at any interval. Frequency refers to the number of reference profile adjustments and/or process parameter measurements made in a particular time frame. Interval refers to the number of logs manufactured between measurements. For example, the process parameter measurements may take about 15 measurements per second for about 1 second at about 3 log intervals.

The frequency and interval of reference profile adjustments may be controlled, in part, by how closely the process parameter measurements match the target process parameters. Reference profile adjustments in a well controlled system with minimal variation may be infrequent. The reference profile adjustments are calculated as needed at any point in the manufacturing process. Reference profile adjustments may be made as needed to maintain at least one process parameter, such as log diameter, within a desired variability. The reference profile 70 may be adjusted at a frequency greater than about once per minute. Alternatively, the reference profile 70 may be adjusted at a frequency greater than about 10 times per second. Preferably, the reference profile 70 may be adjusted at a frequency from about 1 time per minute to about 50 times per second.

The reference profile adjustment intervals may include any interval of logs as needed to maintain control of the manufacturing process. The reference profile 70 may be adjusted between logs such that the reference profile adjustment affects at least one subsequently wound log. The reference profile 70 is preferably adjusted such that the reference profile adjustment affects at least the log being wound. Alternate reference profile adjustment intervals include about every log, about every other log, about every third to fifth log, at least about every sixth to tenth log, about every $100^{th}$ log, about every $1{,}000^{th}$ log and the like. The frequency and or interval of reference profile adjustments are preferably made in accordance with known statistical process control techniques such as those disclosed in American Society for Quality Control (ASQC) document Z1.4-1993 "Sampling Procedures and Tables for Inspection by Attributes."

Generally, at least one process parameter measurement is used to calculate a reference profile adjustment. Therefore, it may be desirable for the frequency of process parameter measurements to equal or exceed the frequency of reference profile adjustments. However, the process parameter measurements may be obtained at any frequency. For instance, the process parameter measurement may be obtained at a frequency greater than about once per minute. Alternatively, the process parameter measurement may be obtained at a frequency greater than about 10 times per second. Preferably, the process parameter measurement may be obtained at a frequency from about 1 time per minute to about 50 times per second.

The interval of measuring one or more process parameters may be any interval of logs needed to maintain control of the manufacturing process. Process parameter measurement interval examples include about every log, about every other log, about every third to fifth log, at least about every sixth to tenth log, about every $100^{th}$ log, about every $1{,}000^{th}$ log and the like. Exemplary intervals are also disclosed in ASQC document Z1.4-1993.

The reference profile may not necessarily be adjusted based on every individual process parameter measurement. The reference profile may be adjusted based on an analysis of more than one process parameter measurement such as by averaging data points. One potential benefit of averaging or analyzing more than one data point vs. responding to a single measurement when adjusting the reference profile 70 is improved log uniformity. Using an 8 log moving average, a pilot test process was able to keep the log diameter within a range of about plus or minus (±) 1.5 millimeters (mm). Preferably, the log diameter variation would be limited to between about ±0.3 mm. A closed-loop algorithm for adjusting the reference profile 70 using an average of the log diameter measurements maintained a log diameter range of about ±0.8 mm over 120 consecutive logs. This was achieved by adjusting the caliper factor, and/or the max line speed.

In one example, the process parameter measured is the log diameter. The reference profile 70 is for the drive system controlling the center wind. At least one log diameter measurement is compared to the target or theoretical log diameter for that point in the winding process. This comparison may be made at one or more points in the winding process. The difference between the measured and the target values at each point are then used to generate a modification to the reference profile 70 based upon a previously established relationship or a correction scale factor. The modified reference profile 70 is used for subsequent log windings until new measurements indicate further changes in the reference profile 70 are needed.

The Apparatus

Figure 2:
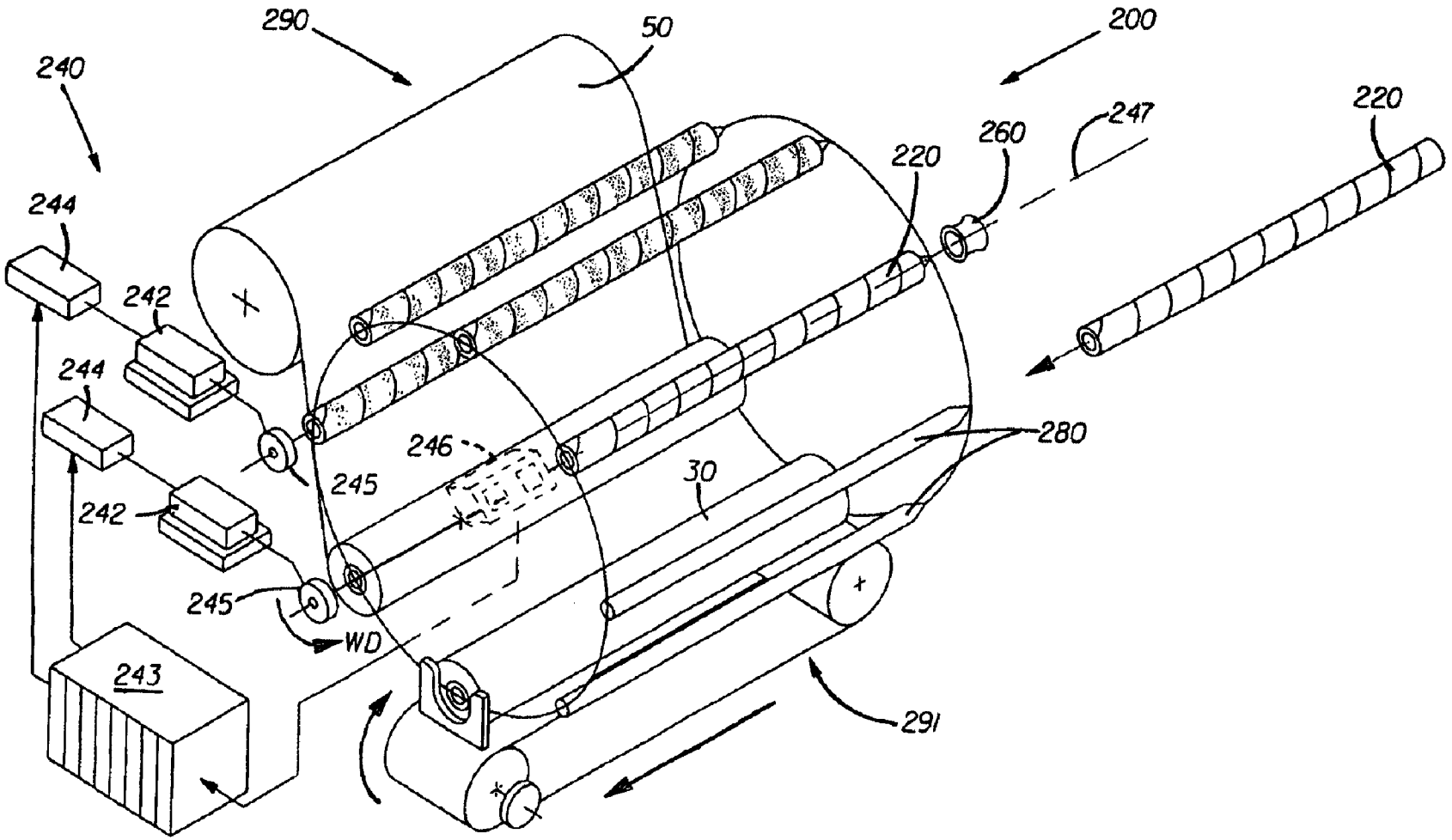
FIG. 2 is a perspective view of a log winding apparatus.

One winding apparatus 200 embodiment may be a center winding apparatus as shown in FIG. 2. The present invention can also be applied to any type of center, turret, translating, non-translating (stationary), rewinder-roll apparatus, or combination thereof. The winding process may operate at any rotational or translational operating speed. The translational and rotational speeds may also vary during the winding process. Apparatuses that are continuously translating may also be used. One example of a continuously translating apparatus is U.S. Pat. No. 5,913,490 issued to McNeil et al.

As shown in FIG. 2, the winding apparatus 200 is designed to wind at least one log 30 of sheet of material 50. The apparatus 200 may include at least one drive system 240, at least one mandrel 280 with a mandrel radius 285 (FIG. 3), at least one material handling system 290, and at least one process parameter measuring device 246. A core 220 is designed to be disposed about the mandrel 280 for winding and removed with the log 30. The mandrel 280 supports the core 220 and rotates to wind the sheet of material 50 about the core. Generally, the core and mandrel are associated with each other on the apparatus 200 such that they have the same rotational velocity (revolutions per minute or RPM) during the winding process. The winding apparatus 200 may also include at least one control means 243 for adjusting the reference profile 70 (FIG. 1) based upon the process parameter measuring device 246. In one embodiment, the control means 243 may be a computer connecting the process parameter measuring device 246 with the drive system 240.

As shown in FIG. 2, the drive system 240 may include at least one drive motor 242, drive controller 244, drive connector 245, and process parameter measuring device 246. The drive connector 245 and mandrel 280 may rotate and/or translate about a central axis 247 during the winding process. Movement about the central axis 247 controls the translation. The drive connector 245 may be used to connect the mandrel 280 with the drive system 240 and rotate the mandrel 280. A preferred embodiment is disclosed in U.S. Pat. No. 5,913,490 issued to McNeil, et al. The drive system 240 may be connected and unconnected with the mandrel 280 as needed when the mandrel(s) 280 are rotated. The drive system 240 connection(s) may be by any means known in the art including but not limited to, a belt, pulley, or chain. The drive system 240 is designed to drive (rotate) the mandrel and/or the sheet of material. The drive system 240 may also convey the sheet of material 50 in a winding direction WD for winding onto the core 220 to form a log 30. The drive system 240 may be controlled by the reference profile 70 (FIG. 1). The drive system 240 preferably uses a digital reference profile 70 for all measurement points during the wind. For instance, the drive system 240 may be adjusted by adjusting each digital reference throughout the reference profile 70. The drive system 240 may control the material handling system 290 and the supply of the sheet of material 50. The drive system 240 may also control the mandrel 280 and the winding of the sheet of material 50 onto the core 220.

As shown in FIG. 2, the material handling system 290 feeds (delivers) the sheet of material 50 to the mandrel 280 and/or core for winding about the core 220. The material handling system 290 may be connected to the drive system 240 or operate independently. A log removal means 291 may be used to assist in the removal of the completed log 30 from the apparatus 200.

The sheet of material 50 is wound about the core 220 in a wind direction WD. The winding apparatus 200 may include a cantilever support (not shown) for one end of the mandrel. The mandrel 280 may also be supported by a removable support such as a removable cupping arm 260 which comes up to support the mandrel 280 during winding and is separated from the mandrel 280 after winding to remove the core 220 and finished log 30 from the mandrel 280 and/or load a new core 220 onto the mandrel 280.

Figure 3:
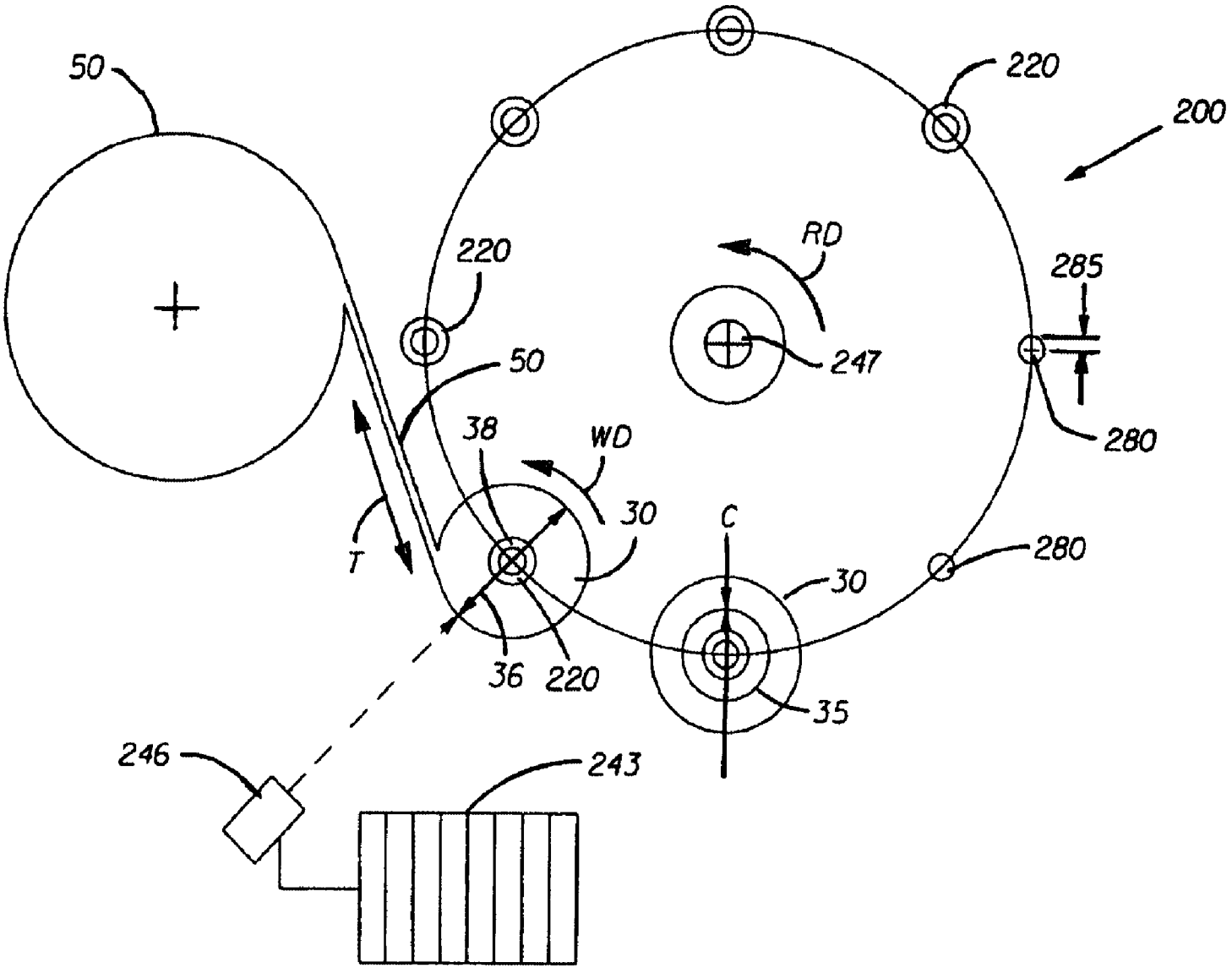
FIG. 3 is a plan side view of one embodiment of the log winding apparatus.

FIG. 3 is a simplified side view of the apparatus 200. As shown in FIG. 3, the mandrel(s) 280 rotate into position for winding about the central axis 247. The mandrels 280 rotate in a rotational direction RD. A tensile load T on the sheet of material 50 during winding may be maintained from about 0 Kilograms force (kgf) per linear centimeter (cm) to about 0.2 kgf per linear cm (about 1 pound force per linear inch). The linear centimeter of the sheet of material 50 is measured generally along the central axis 247, perpendicular to the log diameter 36 measurement as shown in FIG. 2. Preferably, the tensile load T on the sheet of material 50 during winding may be maintained from about 0.001 Kilograms force (kgf) per linear centimeter (cm) to about 0.1 kgf per linear cm. As shown in FIG. 3, the tensile load T and/or the size of the log 30 may affect the compressive load C that may be created on each log layer 35. A log layer 35 is a generally circumferential wind of a sheet of material, which has another sheet of material wound under and/or above it on the log 30.

The process parameter measuring device 246 shown in FIG. 3 is designed to measure process parameters including log diameter, machine degree, drive speed, angular position of the drive motor shaft, displacement of the drive motor shaft, the machine wind cycle point, and combinations thereof The appropriate placement of the process parameter device 246 with respect to the apparatus 200 may vary depending upon the parameter(s) being measured.

The apparatus 200 may also include other capabilities including a means for perforating the sheet of material, adding adhesive to the core, severing the sheet of material after the desired log is wound, loading the core on to the mandrel, delivering a leading portion of the sheet of material to the core, removing the wound log, moving the mandrel supports during winding, and other means known in the art.

Consumer size logs are generally much smaller than commercial size rolls. Consumer logs may include finished products with log diameters less than about 50 cm, log diameters less than about 25 cm, and/or log diameters from about 5 cm to about 35 cm. Consumer logs may weigh less than about 5 kg, weigh less than about 3 kg, and/or weigh from about 50 g to about 2 kg.

Industrial winding operations for relatively large rolls of wound material generally operate at a slower winding speed than the present invention with winding times of 5–60 minutes per commercial roll vs. 1–3 seconds per log for a consumer product. In one embodiment of the present invention, the core rotational velocity change during winding is at least about 400 revolutions per minute between about 2 and about 35 machine degrees. The ability to rapidly change the winding speed, combined with the method and apparatus herein disclosed is designed to enable faster manufacturing speeds, more consistent consumer product log winding, and/or more precise finished log dimensions. The core rotational velocity is measured as core RPM and is independent of any translational velocity of the core about the central axis 247. Alternatively, when winding a log the core revolutions per minute (RPM) may decrease at least about 4 percent (%) in the first 10 revolutions of the log winding, or preferably 8% in the first 20 revolutions of the log winding, or more preferably 12% in the first 30 revolutions of the log winding. These core rotational velocity changes are typical for efficient consumer product log manufacturing but too rapid for industrial sized winding operations. The speed of consumer product winding is one reason that rapid measurements and reference profile 70 adjustments are preferred.

The prior art discloses a high ratio of wound sheet of material inertia relative to the drive's own inertia. Drive inertia includes all the driven mass of the apparatus 200. This includes the drive connector(s) 245, the mandrel(s) 280, and the like. Processes where the sheet of material inertia is greater than the drive inertia are easier to control during the winding process. A typical wound sheet of material (log) to drive inertia ratio in the prior art is 50–5,000 while the log to drive inertia ratio for finished consumer products may vary from about 0.01 to about 0.8. For consumer products, the drive inertia is generally at least about twice that of the log inertia, resulting in a log to drive inertia ratio of less than about 0.5.

The winding apparatus 200 shown in FIG. 2 can be used independently or in conjunction with other components, which control the material tension, and/or the material feed speed to the winding system. The winding apparatus 200 can also be used in conjunction with upstream operations, which control material properties relevant to winding such as thickness, tensile strength, and stretch. Apparatus 200 allows the sheet of material 50 to wind under more uniform tension, thereby improving log 30 quality by providing more consistent log diameter/compressibility and less variation on slit ends due to neck down associated with machine direction MD tension changes. Losses in manufacturing are also minimized. Improved sheet of material control reduces the unintended winding speed fluctuations that may break the sheet of material as it is wound, or result in unmarketable product. Avoiding these problems can allow higher manufacturing speeds and efficiencies.

The Process Parameter Measuring Device

The process parameter measuring device 246 in FIG. 2 and FIG. 3 may measure and/or record data from any point in the winding process. The process parameter measuring device may be attached to the apparatus 200 or mounted independently. In one embodiment the process parameter measuring device 246 may move or translate to track with the moving or translating log 30 during winding. The process parameter measuring device 246 may sense and/or measure a log diameter 36 on the core 220 at one or more machine degrees during the winding process.

As shown in FIG. 2 and FIG. 3, the process parameter measuring device 246 may be connected with a control means 243 for controlling the drive system 240. The drive system 240 may in turn control the winding or unwinding speed of the apparatus 200.

As shown in FIG. 3, the control means 243 may automatically control a log diameter 36 of finished product logs 30 at the winder, and/or sheet of material tension T. The process parameter measuring device data may be correlated with the desired finished product characteristics and an appropriate correction can be made to the reference profile 70 as needed to improve the quality of the finished log 30.

The process parameter data may be any variable that affects the winding quality and/or manufacturing rate of production. Many variables affect the wind quality and manufacturing rate/reliability. These include raw material changes such as caliper, caliper compressibility, moisture content due to raw material supply or environment, and upstream process changes such as increased emboss efficiency over time. These variables cannot typically be controlled within the time period associated with a winding cycle or even several consecutive winding cycles. Therefore, they must be corrected for in the reference profile 70. A timely correction of the reference profile 70 is designed to include measuring one or more critical process parameters during the wind and/or soon enough thereafter to allow timely intervention and adjustment of the reference profile 70.

One such process parameter that may be used to adjust the reference profile 70 is log diameter 36 at intervals throughout the winding process. FIG. 3 shows the log diameter 36. The log diameter increases until the log is complete and a final log diameter may be obtained. It has been found that there is a strong correlation between the log winding speed, winding tension, and the diameter of the log at various incremental points in the winding process. A system has thus been developed to accurately measure log diameter 36 and log diameter changes at one or more points during the winding process.

For example, a log diameter control algorithm compares the measured log diameter 36 at a point in the process with a target value. The mandrel speed reference profile is then manipulated via the Caliper Factor parameter to keep the log diameter 36 at a target value. The present invention may maintain log diameter at a set point about ±0.8 mm.

If the process parameter measuring device 246 shows that the diameter of a winding log is off the target value, a change may be made to the reference profile 70. The reference profile 70 change will automatically yield small adjustments to the mandrel drive speed and reduce the measured log diameter variation from the desired target log diameter value in the present, or subsequent logs.

Other process parameter measurements that may be measured include log diameter, log diameter versus winding time, log diameter versus length of material on the log, the summation of the tension measured during winding, the average of the tension during winding or combinations thereof. These measurements may be used to determine what reference profile adjustments should be made. FIG. 1 has a reference profile of speed vs. machine degrees. Those parameters may be adjusted by changing the caliper factor and/or the max line speed.

Measuring Sensors

The process parameter measuring device 246 may include one or more sensors. The sensor(s) may be contact and/or non-contact sensors. Contact sensors include rollers, stress-strain gauges, micrometers, and the like. Non-contact sensors include lasers, ultrasonic devices, optical devices, LEDs, combinations thereof, and the like. The number of data points sampled per wound log 30 can be anywhere from one to a thousand or more, depending on the level of variation incurred, the required resolution, and the capability of the measuring device. The data points may be taken from one or several logs 30. The sampling data can be used as is or converted to a control number by using a variety of mathematical functions such as averages, means, standard deviations, sums and the like. Other approaches include simple subtraction of actual from theoretical to more sophisticated feed forward logic, Laplace transforms, differential equations, and the like.

Log diameter may be measured using a non-contacting Charge Coupled Device laser sensor available from Keyence®, model LK-503. The non-contacting approach eliminates the possibility of snagging the sheet of material 50 and creating sheet breaks. The charge coupled device laser sensor provides highly accurate and repeatable measurements. Contacting measurement devices, such as linear variable differential transformers may not provide the same level of reliability and repeatability. The LK-503 sensor may be used in "high precision" mode, meaning it has a 200 mm measurement range with 10 micron resolution, and it never physically touches the surface of the winding log. Avoiding contact with the log and sheet of material may be especially important when the process is being run at the high speeds needed to economically produce a consumer product. A user interface (not shown) may provide a "window" to the log diameter control system. The user interface gives the operators the ability to monitor the diameter control system, make set point changes, and change the mode of the diameter controller. These changes may be made manually or preferably automatically by computer control.

In one embodiment the process parameter measuring device 246 may comprise a non-contacting laser sensor available from Keyence®, model LK-503. A process parameter measuring device 246 comprising a non-contacting laser sensor has been tested in two locations under the winding apparatus 200 as shown in FIG. 2 and FIG. 3. The process parameter measuring device 246 was mounted beneath the apparatus 200. As shown in FIG. 3, the process parameter measuring device 246 was fixed in place and aimed at a log 30 dwell position 38, allowing it to see valid data for approximately ⅓ of each 360 machine degree wind cycle or from about 120 to about 240 machine degrees. The dwell position 38 is the point in the wind process where the mandrel is no longer translating but stationary while winding. The process parameter measuring device 246 was later moved to a second location under the bedroll assembly. The process parameter measuring device 246 was fixed in place and aimed at the chop-off position. The chop-off position is near the end of the winding cycle when the sheet of material is cut at about 360 machine degrees. A portion of the sheet of material may continue to be wound. A log diameter 36 measurement was taken once for each log wind cycle, at approximately 356 machine degrees.

In a more preferred embodiment, the Keyence® laser sensor can be aimed at the start of wind position and then continuously articulated to aim at the center of the winding log until the winding cycle is completed. A second sensor system can be used with the first sensor system. The second sensor may be aimed at the winding start position while the first sensor system is aimed at the log chop-off position, and vice versa as needed. Two or more sensors may be used to ensure no winding measurements are missed on consecutive logs 30 that are at different positions (e.g. translating) in the wind cycle.

The sensors may measure distance using triangulation principles. A semiconductor laser beam is reflected off the target surface and passes through a receiver lens system. The beam is focused on a charge-coupled device sensing array. The charge-coupled device detects the peak value of the light quantity distribution of the beam spot for each pixel (individual charge coupled device sensing element) within the area of the beam spot and determines the precise target position. As the target displacement changes relative to the sensor head, the reflected beam position changes on the charge coupled device array. These positional changes are analyzed by the controller that resolves positional changes as small as 50.0 microns. Charge-coupled device technology has a discrete sensing element design, and precisely determines the peak value of the beam spot light distribution and will accurately measure the target's position to 50.0 microns.

The non-contacting Keyence® laser sensor may be connected to the control means 243 by any means known in the art. One example is a 10 m extension cable available from Keyenceo®, model LK-C10. The control means 243 may be a Keyence®, model LK-2503 controller. The control means 243 may be DIN-rail mounted. The control means 243 may be powered by a Siemens 24 VDC power supply. The power supply may also be mounted on a DIN-rail. The control means 243 may broadcast a ±10V signal on terminals 13 and 14. This signal corresponds to the laser's 250 mm to 450 mm measurement range in "high precision" mode. The signal may be transmitted to an AutoMax Analog Input Card (57C409) in AutoMax Rack A02, Slot 07. The signal may be transmitted on Belden-M 87703C18 shielded cable. This is 3-conductor wire, but only two of the three leads are required. The shield wire is terminated at the field termination cabinet for the AutoMax Rack A02. The AutoMax Analog Input Card uses 12-bit A/D conversion. This yields a resolution of 1.92 mils or a diameter resolution of 3.84 mils.

The Sheet of Material

The Sheet of Material 50 being wound can be any flexible material that can be rolled into a log. Sheet of Material 50 examples include any film, metal foil, paper, cloth, food, woven, scrim, mesh, nonwoven, combination thereof and the like. Single or multiple layers within the sheet of material structure are contemplated, whether co-extruded, extrusion-coated, laminated, or combined by other known means.

Useful films include, but are not limited to, polyethylenes (PE) (including high density polyethylene, HDPE, low density polyethylene, LDPE and linear low density polyethylene, LLDPE), polypropylene (PP), polyethylene terephthalate (PET), polyvinyl chloride (PVC), polyvinylidene chloride (PVDC), ethylene vinyl acetate (EVA), latex structures, nylon, surlyn, mixtures thereof, and the like. A preferred resin is a blend of EVA and polypropylene. Any film may be used including thermoplastic non-resilient flexible film. Perforated or porous films may also be used as a sheet of material.

Figure 4A:
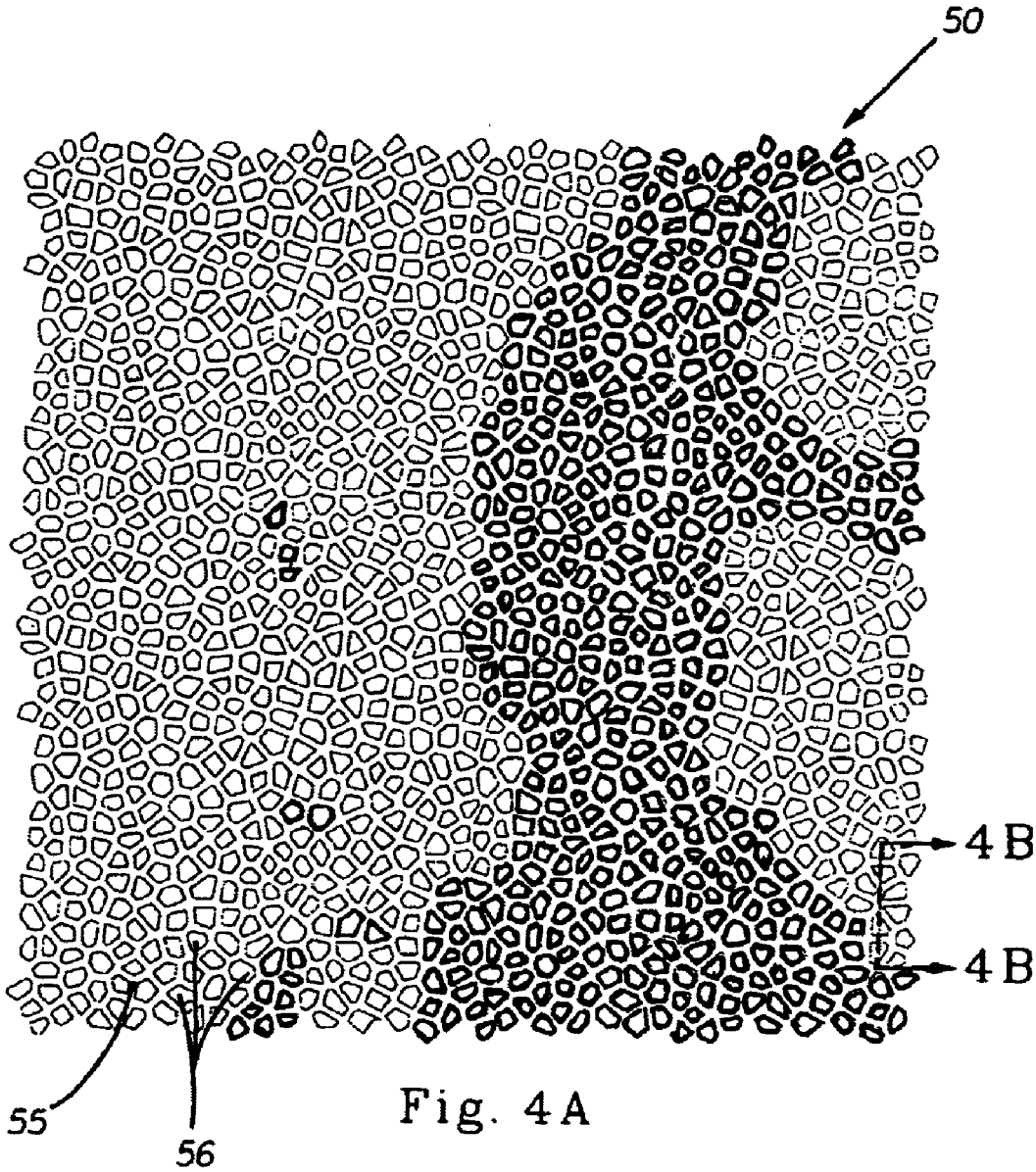
FIG. 4A is a plan top view of a three dimensional sheet.
Figure 4B:
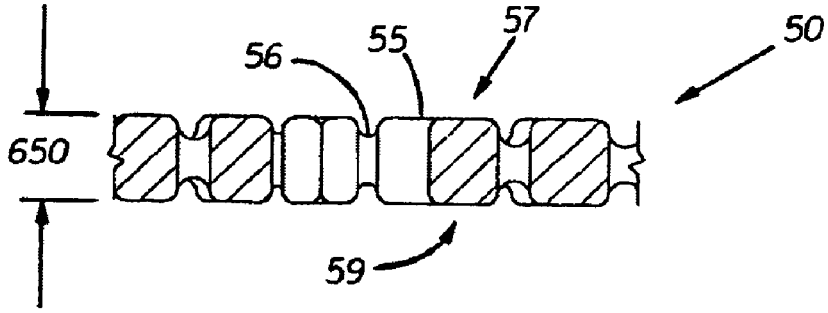
FIG. 4B is a plan side view of a three dimensional sheet.

As shown in FIG. 4A and FIG. 4B, the sheet of material 50 may be a three-dimensionally shaped formed film. Three-dimensionally shaped formed films may have a film thickness 650 of from about 0.0001 inch (0.1 mil) to about 0.009 inches (9 mil), preferably about 0.5 mil to about 6 mils, more preferably about 3–5 mils. A preferred sheet of material 50 includes an adhesive material. The adhesive material may be applied to a first surface 57, a second surface 59, or to both surfaces of the sheet of material 50. The three-dimensional film first surface 57 may comprise a plurality of recessed pressure sensitive adhesive sites 56 and a plurality of collapsible protrusions 55. The protrusions serve as stand-offs to prevent premature sticking of the adhesive sites to a target surface until a force sufficient to collapse at least a portion of the collapsible protrusions 55 has been applied to the second surface 59.

As shown in FIG. 3, the log layer 35 compressive force C is preferably less than the force sufficient to collapse more than about 30% of the collapsible protrusions 55 in a log layer 35. More preferably, the log layer 35 compressive force C is less than the force sufficient to collapse more than about 20% of the collapsible protrusions 55 in a log layer 35.

A preferred three-dimensional film having an adhesive applied on one surface for use as the sheet of material 50 is described in U.S. Pat. No. 5,871,607 issued to Hamilton et al., U.S. Pat. No. 5,662,758 issued to Hamilton et al., U.S. Pat. No. 5,968,633 issued to Hamilton et al., and U.S. Pat. No. 5,965,235 issued to McGuire et al.

The sheet of material 50 may come in a large roll as shown in FIG. 2 and FIG. 3. The sheet of material may be wound about multiple cores as necessary to complete consumer sized logs.

An On Line Example

A method of using the winding apparatus 200 shown in FIG. 2 to wind a sheet of material 50 onto a core 220 to form a log 30 may include winding the sheet of material 50 to form the log 30 in accordance with a reference profile 70 shown in FIG. 1. At least one process parameter may then be measured to obtain at least one process parameter measurement. The reference profile 70 may then be adjusted according to the at least one process parameter measurement.

In one example shown in FIG. 3, the process parameter measuring device 246 measures the log diameter 36 and the data is incorporated into a log diameter control program in an existing control means 243. The algorithm starts by computing a theoretical sheet caliper based on the log diameter set point entered at the operator interface. At every processing cycle, the theoretical sheet caliper, sheet count, sheet length, and/or current machine position are used to calculate a theoretical log diameter. For example, if a process parameter is sampled at a machine position of 356 degrees, and the ideal caliper is 22.89 mils (0.581406 mm) for an 11 inches long (279.4 mm), 72 sheet count product, the theoretical diameter will be calculated as 5.08 inches (129.032 mm). If the machine position is at chop-off, or 360 machine degrees, the theoretical diameter will be 5.10 inches (129.54 mm).

The log diameter control program uses data from the process parameter-measuring device 246 to adjust the reference profile 70 (FIG. 1) as needed. The log diameter control program monitors the machine position and incorporates the measured diameter data from the process parameter measuring device 246 as soon as a machine degree position reaches a defined value. In this example, the value chosen was 356 machine degrees. The measured diameter is subtracted from the theoretical diameter as calculated above, and any difference results in an error that is assessed by the control means 243. In the present example, a configurable four-point moving average block was used to assess the error. The output of the moving average is then used to calculate a "trim" value for the existing caliper factor parameter, if the average falls outside a user definable preconfigured control limit. A control limit of 25 mils (±0.635 mm) was used in this example. In this example, the minimum value for this caliper factor "trim" is 0.1 mil. (0.00254 mm). The trim value is subtracted from (or added to) the nominal caliper factor setting to change the reference profile 70. The control means 243 then changes the process by directing a change to the mandrel rotational velocity. In this embodiment, the log diameter control algorithm may take the form of an integral-only controller. The 25 mil (±0.635 mm) preconfigured control limit helps reduce and/or prevent controller oscillations at steady-state operation. Such oscillations may result from the fact that caliper factor changes can only occur in 0.1 mil increments or larger. This corresponds very approximately to roll diameter changes of 10 mils (0.010" or 0.254 mm).

Once a control move has occurred, the process may continue and repeat adjustments as necessary until the average measured error is within the user definable preconfigured control limit. Once the average error is inside the user definable preconfigured control limit, the log diameter control program will cease manipulation of caliper factor, but will continue to monitor the average error. Control activity will resume if the average error exceeds the preconfigured control limit.

The program may be written such that if the operator deactivates the log diameter control, the accumulated caliper factor change will be reset to zero and the mandrel speed reference tables will be recalculated based on the original, nominal caliper factor value. The program may alternatively integrate some, if not all, of the accumulated caliper factor change into a "new" nominal caliper factor value for the initial reference profile 70 for use in subsequent operations.

Off Line Measurements

Figure 5:
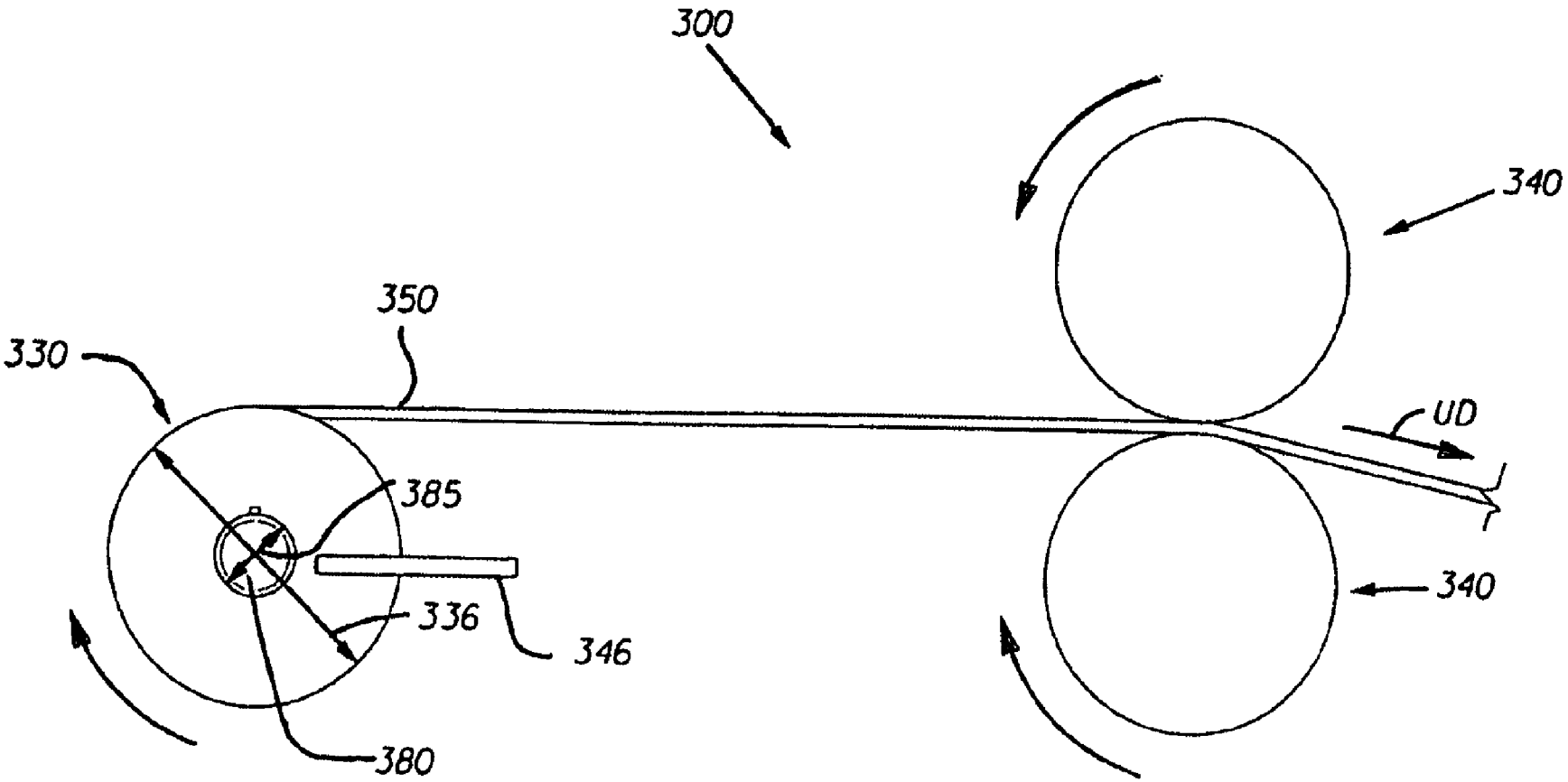
FIG. 5 is a plan side view of a log unwinding apparatus.

Process parameter measurements for adjusting the wind apparatus 200 reference profile may also be taken "off line," on a log after is has been wound and preferably removed from the wind apparatus 200. These process parameter measurements may be taken using an unwind apparatus. FIG. 5 shows an unwind apparatus 300 for unwinding a log 330 of a sheet of material 350 and taking at least one process parameter measurement. The unwind apparatus may also measure at least one process parameter measurement having a correlation to the reference profile 70. For example, the unwinding force throughout the log 330 as it is unwound may be measured. This process parameter measurement data has been found to have a strong correlation with the winding diameter, winding speed, and wind tension. This process parameter measurement data may then be used as desired to adjust the reference profile 70 of a winding apparatus used to subsequently manufacture logs. An unwind apparatus 300 may be used to unwind any sheet of material 350 including those previously disclosed. Unwind measurements are particularly useful for consumer products where the consumer will be removing the product from the log 330. One such product includes a film coated with a pattern of adhesive where the unwind tensions may be different from the wind tensions. The unwind apparatus 300 may also be used for measuring the log diameter 336 of the log 330 at different points in the winding process. As the log 330 is unwound the sheet of material 350 is removed and the remaining log diameter 336 can be related to a particular machine degree or coordinated with the known length of sheet of material 350 remaining on the log 330.

As shown in FIG. 5, the unwind apparatus 300 for unwinding a log 330 of a sheet of material 350 may include, a pull system 340, an unwind mandrel 380 about which the log is placed, and at least one unwind measuring device 346. The pull system 340 is used to pull the sheet of material 350 off the log 330 in an unwind direction UD. The unwind mandrel 380 has an unwind mandrel diameter 385. The log 330 is placed on the unwind mandrel 380 for unwinding. A portion of the sheet of material 350 is attached to the pull system 340. The pull system 340 pulls the sheet of material 350 off the log 330 while the unwind measuring device 346 obtains at least one process parameter measurement.

At least one unwind measuring device 346 is designed to measure any desired process parameter. The unwind measuring device 346 measures at least one process parameter, at least once, as the pull system 340 pulls the sheet of material 350 of the log 330 in an unwind direction UD. Process parameter measurements may include log diameter, unwind speed, angular position of the unwind motor shaft, displacement of the unwind shaft, the machine unwind cycle point, machine degrees, pull speed, pull tension (force), pull angle, log diameter versus unwinding time, log tension required to unwind the log, log diameter versus length of material on the log, the summation of the tension measured during unwinding, the average of the tension during unwinding and combinations thereof.

Figure 6:
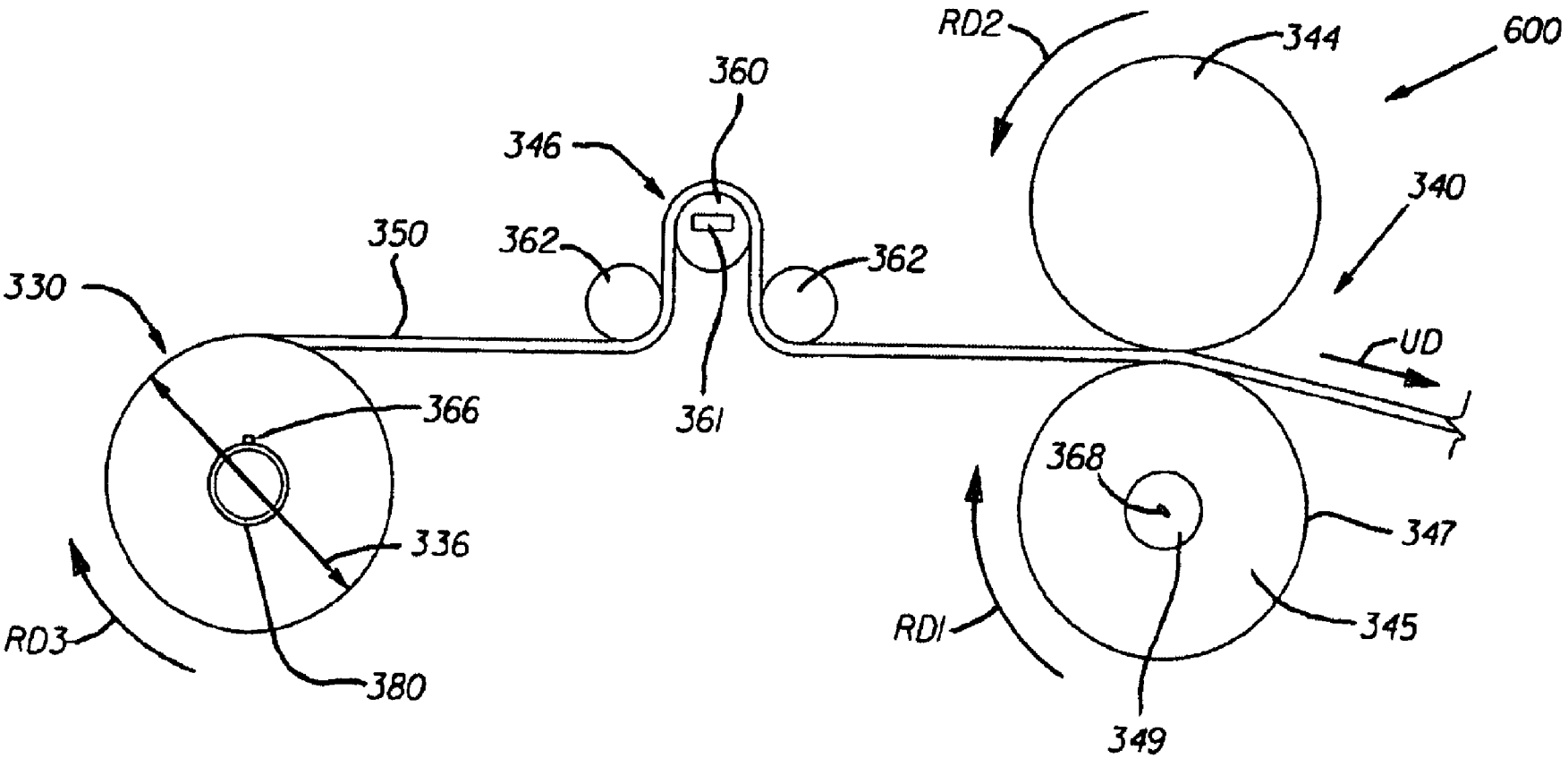
FIG. 6 is a plan side view of a log unwinding apparatus with a nip roll.

In one embodiment shown in FIG. 6, the unwind apparatus 600 pull system 340 includes at least one nip roll 345 with a nip shaft 349 and nip circumference 347. The pull system 340 may also include a second nip roll 344. The nip roll 345 is designed to be rotated and unwind the material 350 from the log 330. The nip roll 345 has a nip circumference 347 and acts with the second nip roll 344 to rotate and unwind the sheet of material 350 from the log 330 in the unwind direction UD. The nip roll 345 rotates in a rotational direction RD1. The second nip roll 344 rotates in a second rotational direction RD2. The log 330 is unwound in a third rotational direction RD3. A proximity sensor 366 may be located on the mandrel 380 to measure log rotation. The proximity sensor 366 determines when exactly one revolution of the log 330 has occurred. The angular displacement on shaft 349 and the nip circumference 347 is then used to calculate the length of the sheet of material 350 removed from the log 330 in that one revolution of the log 330. The length of the sheet of material 350 removed from the log 300 may then be correlated to a log diameter 336. Successive measurements then provide log diameter 336 changes in adjoining wound layers, thereby providing in-wound tension data. Successive diameter measurements can then also emulate the unwind log diameter 336 at various points (e.g. machine degrees) in the winding process. Alternatively, a laser triangulation system or other known device can be used to measure the unwind log diameter 336 directly in the off-line system. A second sensor 368 for measuring angular displacement may be connected to shaft 349.

As shown in FIG. 6, the unwind measuring device 346 may include having the sheet of material 350 routed over an idler roller 360 located between the log 330 and the nip roll 345. Two guide rollers 362 may be used with the idler roller 360. The idler roller 360 may be mounted on load cells 361, which can measure the force exerted within the unwind direction UD of the sheet 350 to pull the sheet 350 off the log 330. The unwind direction UD may also be known as the machine direction. The nip roll 345 can then be rotated in rotational direction RD1 to unwind the sheet 350 from the log 330. The proximity sensor 366 can measure the log 330 rotations and determine the unwinding force vs. the position in the log 330. The unwinding force profile is then compared to the reference profile 70 and correction factors may then be calculated and fed back into the winding apparatus drive controller. This provides a means to maintain more consistent forces between adjoining sheet of material 350 layers through the log 330, thereby improving the ease and uniformity of dispensing (unrolling) product from the log 330.

If the process parameter measurement is taken off-line by unwinding and measuring a sample log 330, the system can be manual or automated. Preferably, the unwind measuring device is automated. An automated unwind measuring device would include gathering the unwind measuring device process parameter measurements and changing the reference profile used in a winding apparatus without the need for operator data entry or calculations. The apparatus and methods herein disclosed are designed to provide accurate data quickly that correlated well with production results and other lab tests previously used.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of using a winding apparatus to wind a sheet of material onto a core to form a log, comprising the steps of:

winding the sheet of material about the core in accordance with a reference profile;

measuring a process parameter to obtain at least one process parameter measurement;

providing a reference profile adjustment according to the at least one process parameter measurement; and adjusting the reference profile according to the reference profile adjustment, the core having a rotational velocity change of at least about 400 revolutions per minute between about 2 and about 35 machine degrees.

2. The method of claim 1, wherein a tensile force on the sheet of material is maintained from about 0 kgf per linear cm to about 0.2 kgf per linear cm.

3. The method of claim 1, wherein the winding apparatus is a center winding apparatus.

4. The method of claim 1, wherein the process parameter measurement is selected from the group consisting of log diameter, log diameter versus winding time, log diameter versus length of material on the log, the summation of the tension measured during winding, the average of the tension during winding and combinations thereof.

5. The method of claim 1, wherein the reference profile is adjusted based upon the process parameter measurement vs. a target process parameter.

6. The method of claim 5, wherein the process parameter measurement is measured at least once from about 340 machine degrees to about 360 machine degrees.

7. The method of claim 1, wherein adjusting the reference profile affects at least the log being wound.

8. The method of claim 1, wherein adjusting the reference profile affects at least one subsequently wound log.

9. The method of claim 1, wherein the apparatus has a drive inertia, the log has a log inertia, and the log inertia to drive inertia ratio is less than about 0.5.

10. A winding apparatus for winding a sheet of material to meet a reference profile, the apparatus comprising:

a mandrel with a removable core disposed about the mandrel, a material handling system for delivering the sheet of material to the core;

a drive system for rotating the mandrel and core, the drive system winding the sheet of material onto the core to form a log, the core having a rotational velocity change of at least about 400 revolutions per minute between about 2 and about 35 machine degrees;

at least one process parameter measuring device to obtain at least one process parameter measurement, the at least one process parameter measurement being used to calculate a reference profile adjustment, the reference profile adjustment being used to modify the reference profile.

11. The winding apparatus of claim 10, wherein the process parameter measurement is selected from the group consisting of log diameter, log diameter versus winding time, log diameter versus length of material on the log, the summation of the tension measured during winding, the average of the tension during winding and combinations thereof.

12. The winding apparatus of claim 10, wherein the process parameter measurement is obtainable at a frequency greater than about 10 times per second.

13. The winding apparatus of claim 10, wherein the reference profile is adjustable at a frequency from about 1 time per minute to about 50 times per second.

14. The winding apparatus of claim 10, further comprising:

a control means for adjusting the reference profile.

15. The winding apparatus of claim 10, wherein the sheet of material is selected from the group consisting of film, food, nonwoven, woven, and combinations thereof.

16. The winding apparatus of claim 10, wherein the core revolutions per minute decrease at least about 4 percent in the first 10 revolutions of the log winding.

17. The winding apparatus of claim 10, wherein the apparatus has a drive inertia, the log has a log inertia, and the log inertia to drive inertia ratio is less than about 0.5.

18. The winding apparatus of claim 10, wherein the sheet of material comprises a three-dimensional film having a first surface and a second surface;

the first surface comprising a plurality of recessed pressure sensitive adhesive sites and a plurality of collapsible protrusions that serve as stand-offs to prevent premature sticking of the adhesive sites to a target surface until a force sufficient to collapse the protrusions has been applied to the second surface.

19. The winding apparatus of claim 18, wherein the log includes at least one log layer, the log layer having a compressive force that is less than the force sufficient to collapse more than about 30% of the collapsible protrusions in any one log layer.

* * * * *